US008911574B2

(12) United States Patent
Ootsuka et al.

(10) Patent No.: US 8,911,574 B2
(45) Date of Patent: Dec. 16, 2014

(54) METHOD FOR MANUFACTURING HIGH-SI COLD ROLLED STEEL SHEET HAVING EXCELLENT CHEMICAL CONVERSION PROPERTIES

(75) Inventors: Shinji Ootsuka, Fukuyama (JP); Junichiro Hirasawa, Chiba (JP); Hideyuki Takahashi, Fukuyama (JP); Naoto Yoshimi, Kawasaki (JP); Hideki Nagano, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 255 days.

(21) Appl. No.: 13/637,804

(22) PCT Filed: Mar. 28, 2011

(86) PCT No.: PCT/JP2011/058477

§ 371 (c)(1),
(2), (4) Date: Sep. 27, 2012

(87) PCT Pub. No.: WO2011/122694

PCT Pub. Date: Oct. 6, 2011

(65) Prior Publication Data

US 2013/0048157 A1 Feb. 28, 2013

(30) Foreign Application Priority Data

Mar. 29, 2010 (JP) ..... 2010-074466

(51) Int. Cl.

| | |
|---|---|
| ***C21D 9/00*** | (2006.01) |
| ***C21D 1/52*** | (2006.01) |
| ***C21D 1/26*** | (2006.01) |
| ***C22C 38/00*** | (2006.01) |
| ***C21D 1/76*** | (2006.01) |
| ***C22C 38/06*** | (2006.01) |
| ***C21D 6/00*** | (2006.01) |
| ***C22C 38/02*** | (2006.01) |
| ***C22C 38/04*** | (2006.01) |
| ***C21D 8/04*** | (2006.01) |
| ***C21D 9/56*** | (2006.01) |
| *C21D 8/02* | (2006.01) |

(52) U.S. Cl.

CPC ..... *C22C 38/02* (2013.01); *C22C 38/001* (2013.01); *C21D 1/76* (2013.01); *C21D 8/0273* (2013.01); *C22C 38/06* (2013.01); *C21D 6/008* (2013.01); *C22C 38/04* (2013.01); *C21D 8/0473* (2013.01); *C21D 9/561* (2013.01); *C21D 8/0236* (2013.01)

USPC ..... 148/579; 148/633; 148/634; 148/655; 148/307; 148/112

(58) Field of Classification Search

None

See application file for complete search history.

(56) References Cited

U.S. PATENT DOCUMENTS

| | | | | |
|---|---|---|---|---|
| 8,216,695 | B2 * | 7/2012 | Nakanishi et al. | 428/659 |
| 8,668,789 | B2 * | 3/2014 | Hirasawa et al. | 148/661 |

FOREIGN PATENT DOCUMENTS

| | | | |
|---|---|---|---|
| JP | 55-145122 | A | 11/1980 |
| JP | 9-310148 | A | 12/1997 |
| JP | 2003-113441 | A | 4/2003 |
| JP | 2004-323969 | A | 11/2004 |
| JP | 2006-45615 | A | 2/2006 |
| JP | 2007-262479 | A | 10/2007 |
| JP | 2008-069445 | A | 3/2008 |
| JP | 2010-53446 | A | 3/2010 |
| JP | 2010-59510 | A | 3/2010 |

OTHER PUBLICATIONS

International Search Report dated Jul. 5, 2011, application No. PCT/JP2011/058477.

* cited by examiner

*Primary Examiner* — Deborah Yee
(74) *Attorney, Agent, or Firm* — RatnerPrestia

(57) ABSTRACT

A method for manufacturing high-Si cold rolled steel sheets includes heating a cold rolled steel sheet with a direct flame burner (A) having an air ratio of not more than 0.89 when the temperature of the cold rolled steel sheet that is being increased is in the temperature range of not less than 300° C. and less than Ta° C., subsequently heating the cold rolled steel sheet with a direct flame burner (B) having an air ratio of not less than 0.95 when the temperature of the cold rolled steel sheet is in the temperature range of not less than Ta° C. and less than Tb° C., and subsequently soak-annealing the cold rolled steel sheet in a furnace having an atmospheric gas composition which has a dew point of not more than −25° C. and contains 1 to 10 volume % of $H_2$ and the balance of $N_2$.

6 Claims, No Drawings

METHOD FOR MANUFACTURING HIGH-SI COLD ROLLED STEEL SHEET HAVING EXCELLENT CHEMICAL CONVERSION PROPERTIES

CROSS REFERENCE TO RELATED APPLICATIONS

This application is the U.S. National Phase application of PCT International Application No. PCT/JP2011/058477, filed Mar. 28, 2011, and claims priority to Japanese Patent Application No. 2010-074466, filed Mar. 29, 2010, the disclosures of both applications being incorporated herein by reference in their entireties for all purposes.

FIELD OF THE INVENTION

The present invention relates to method for manufacturing automotive high-Si (silicon) cold rolled steel sheet that will be painted after being subjected to chemical conversion treatment such as phosphatization. In particular, the invention relates to the manufacturing of high-Si cold rolled steel sheet which exhibits a tensile strength of not less than 590 MPa due to the solid solution strengthening ability of Si and have excellent workability with TS×EL being not less than 18000 MPa·%.

BACKGROUND OF THE INVENTION

From the viewpoint of the weight reduction of automobiles, there have recently been increasing demands for high strength cold rolled steel sheets having a tensile strength of not less than 590 MPa. Automotive cold rolled steel sheets are subjected to a chemical conversion treatment called phosphatization as a pretreatment prior to painting. Chemical conversion treatment of cold rolled steel sheets is one of the important treatments in order to ensure corrosion resistance after painting.

The addition of Si is effective for increasing the strength of cold rolled steel sheets. During continuous annealing, however, silicon is oxidized even under an atmospheric gas composition including reducing $N_2$ and $H_2$ which does not induce the oxidation of Fe (which reduces Fe oxides). As a result, a thin film of Si oxide ($SiO_2$) is formed on the outermost surface of a steel sheet. This Si oxide inhibits a reaction forming a chemical conversion layer during chemical conversion treatment, thereby resulting in micro areas (non-covered areas) where any chemical conversion layer is not formed. Thus, chemical conversion properties are lowered.

Among conventional technologies addressing the improvement of the chemical conversion properties of high-Si cold rolled steel sheets, Patent Literature 1 describes a method in which the steel sheet temperature is brought to 350 to 650° C. in an oxidizing atmospheric gas so as to form an oxide film on the surface of steel sheet, and thereafter the steel sheet is heated to a recrystallization temperature in a reducing atmospheric gas and subsequently cooled.

Further, Patent Literature 2 describes a method for manufacturing cold rolled steel sheets containing, in terms of mass %, Si at not less than 0.1% and/or Mn at not less than 1.0%, which includes forming an oxide film on the surface of steel sheet at a steel sheet temperature of not less than 400° C. under an iron oxidizing atmospheric gas composition, and thereafter reducing the oxide film on the surface of steel sheet under an iron reducing atmospheric gas.

Furthermore, Patent Literature 3 describes a high strength cold rolled steel sheet which contains Si at not less than 0.1 wt % and not more than 3.0 wt % and has a superficial layer that contains an oxide effective for improving properties such as chemical conversion properties in crystal grain boundaries and/or within crystal grains. Patent Literature 4 describes a steel sheet with excellent phosphatability in which when a cross section in a direction perpendicular to the surface of steel sheet is observed with an electron microscope at a magnification of 50000× or more, the proportion of a Si-containing oxide occupying the cross section over a 10 μm length of the surface of steel sheet is not more than 80% in terms of an average of randomly selected 5 points. Patent Literature 5 describes a high strength cold rolled steel sheet with excellent chemical conversion properties which contains, in terms of mass %, C at more than 0.1% and Si at not less than 0.4%, and has a Si content (mass %)/Mn content (mass %) ratio of not less than 0.4 and a tensile strength of not less than 700 MPa, and in which a Si-based oxide containing Si as a main component covers the surface of steel sheet at a surface coverage ratio of not more than 20% by area, and the largest circle inscribed in the region covered by the Si-based oxide has a diameter of not more than 5 μm. Patent Literature 6 describes a high strength steel sheet with excellent chemical conversion properties containing, in terms of mass %, C at 0.01 to 0.3%, Si at 0.2 to 3.0%, Mn at 0.1 to 3.0% and Al at 0.01 to 2.0% and having a tensile strength of not less than 500 MPa, wherein crystal grains of the surface of steel sheet have an average grain diameter of not more than 0.5 μm, further wherein when an observation region of the surface of steel sheet that is not less than 10 μm in width is sliced into a thin piece for cross sectional TEM observation and when the thin piece sample is observed by TEM under such conditions that oxides 10 nm or less in size are observable, an oxide species including one or two of silicon oxide and manganese silicate at a total content of not less than 70 mass % is present at not more than 30% relative to the surface of a grain boundary region viewed with respect to the cross section, and wherein the oxide species that is present in a region found at a depth of 0.1 to 1.0 μm from the surface of steel sheet has a grain diameter of not more than 0.1 μm.

PATENT LITERATURE

[PTL 1] Japanese Unexamined Patent Application Publication No. 55-145122

[PTL 2] Japanese Unexamined Patent Application Publication No. 2006-45615

[PTL 3] Japanese Patent No. 3386657

[PTL 4] Japanese Patent No. 3840392

[PTL 5] Japanese Unexamined Patent Application Publication No. 2004-323969

[PTL 6] Japanese Unexamined Patent Application Publication No. 2008-69445

SUMMARY OF THE INVENTION

In the manufacturing method of Patent Literature 1, the thickness of the oxide film formed on the surface of steel sheet is variable depending on an oxidation method. In some cases, the oxide film becomes excessively thin to permit the formation of Si oxide on the surface of steel sheet, or the oxidation does not take place sufficiently. Alternatively, the oxide film becomes so thick in some cases that the oxide film remains or is exfoliated during the subsequent annealing in a reducing gas so as to deteriorate surface properties. The EXAMPLES of this literature describe a technique in which oxidation is performed in the air. However, oxidation in the air results in the formation of thick oxide film, which gives rise to problems such as difficult subsequent reduction or a need for a reducing atmosphere with high hydrogen concentration.

In the manufacturing method according to Patent Literature 2, Fe on the surface of a steel sheet is oxidized at 400° C. or above using a direct flame burner with an air ratio of not less than 0.93 and not more than 1.10, and thereafter the steel sheet is annealed in an atmospheric gas which contains $N_2$ and $H_2$ reducing the Fe oxide. In this manner, the method suppresses the oxidation of $SiO_2$ which lowers chemical conversion properties from occurring on the outermost surface, and forms a reduced layer of Fe on the outermost surface. Patent Literature 2 does not specifically describe the heating temperature with the direct flame burner. However, in the case where Si is present at a high content (0.6% or more), the oxidation amount of Si, which is more easily oxidized than Fe, is increased so as to suppress the oxidation of Fe or allow for excessively little oxidation of Fe itself. As a result, the formation of a superficial reduced layer of Fe by reduction becomes insufficient and $SiO_2$ comes to be present on the surface of steel sheet after reduction, thus possibly resulting in areas non-covered with a chemical conversion layer.

According to the steel sheet of Patent Literature 3, a Si oxide is formed inside the steel sheet and no Si oxide is allowed to be present on the surface in order to improve chemical conversion properties. A method for manufacturing such steel sheets is such that after hot rolling which is a stage previous to cold rolling, a steel sheet is coiled at a high temperature (good results were obtained at 620° C. or above in EXAMPLES) and a Si oxide is formed inside the steel sheet. However, because the cooling rate is high at the outside of the hot coil and is low at the inside of the hot coil, large temperature variations are caused in the longitudinal direction of the steel sheet. Thus, it is difficult to obtain a uniform surface quality over the entire length of the hot coil.

All of Patent Literatures 4, 5 and 6 specify the upper limit of the amount of Si oxide covering the surface of steel sheet in different respective ways. A method for manufacturing such steel sheets is such that the dew point (or the vapor hydrogen partial pressure ratio) of an atmospheric gas composition containing reducing $N_2$ and $H_2$ is regulated within a specific range during heating or soaking in continuous annealing so as to oxidize Si inside the steel sheet. The dew point of such gas is described to be not less than −25° C. in Patent Literature 4, and from −20° C. to 0° C. in Patent Literature 5. In Patent Literature 6, the range of vapor hydrogen partial pressure ratio is specified in each step of preheating, heating and recrystallization. In general, the dew point of a gas with a composition including $N_2$ and $H_2$ is −25° C. or less. Thus, it is necessary in these methods that the dew point be controlled so as to be higher than such a temperature by, for example, introducing vapor or air. This causes problems from the viewpoint of operation controllability. As a result, good chemical conversion properties are not obtained stably. Further, because increasing the dew point (or increasing the vapor hydrogen partial pressure ratio) increases the oxidation properties of the atmospheric gas, it has been often encountered that the degradation of furnace walls and rolls in the furnace is accelerated as well as that scale defects called pickups are generated on the surface of steel sheet.

The present invention is aimed at solving the aforementioned problems. The invention provides methods for manufacturing high-Si cold rolled steel sheets which achieve good chemical conversion properties without any control of the dew point of a gas having a reducing composition that is used in a soaking furnace for soak-annealing of steel sheet or without any control of the vapor hydrogen partial pressure ratio and in spite of a Si content of not less than 0.6% and which exhibit a tensile strength of not less than 590 MPa and excellent workability with TS×EL being not less than 18000 MPa·%.

Means according to embodiments of the invention for solving the aforementioned problems are as follows.

(1) A first method for manufacturing high-Si cold rolled steel sheets having excellent chemical conversion properties which includes a step of heating a cold rolled steel sheet that has a chemical composition containing:

C at 0.05 to 0.3 mass %,
Si at 0.6 to 3.0 mass %,
Mn at 1.0 to 3.0 mass %,
P at not more than 0.1 mass %,
S at not more than 0.05 mass %,
Al at 0.01 to 1 mass %, and
N at not more than 0.01 mass %, with the balance being represented by Fe and inevitable impurities, with use of a direct flame burner (A) having an air ratio of not more than 0.89 when the temperature of the cold rolled steel sheet that is being increased is in the temperature range of not less than 300° C. and less than Ta° C., a step of subsequently heating the cold rolled steel sheet with use of a direct flame burner (B) having an air ratio of not less than 0.95 when the temperature of the cold rolled steel sheet is in the temperature range of not less than Ta° C. and less than Tb° C., and a step of subsequently soak-annealing the cold rolled steel sheet in a furnace having an atmospheric gas composition which has a dew point of not more than −25° C. and contains 1 to 10 volume % of $H_2$ and the balance of $N_2$, with the proviso that 450° C.≤Ta° C.≤550° C. and 650° C.≤Tb° C.≤800° C.

(2) A second method for manufacturing high-Si cold rolled steel sheets having excellent chemical conversion properties which includes a step of heating a cold rolled steel sheet that has a chemical composition containing:

C at 0.05 to 0.3 mass %,
Si at 0.6 to 3.0 mass %,
Mn at 1.0 to 3.0 mass %,
P at not more than 0.1 mass %,
S at not more than 0.05 mass %,
Al at 0.01 to 1 mass %, and
N at not more than 0.01 mass %, with the balance being represented by Fe and inevitable impurities, with use of a direct flame burner (A) having an air ratio of not more than 0.89 when the temperature of the cold rolled steel sheet that is being increased is in the temperature range of not less than 300° C. and less than Ta° C., a step of subsequently heating the cold rolled steel sheet with use of a direct flame burner (B) having an air ratio of not less than 0.95 when the temperature of the cold rolled steel sheet is in the temperature range of not less than Ta° C. and less than Tb° C., and a step of subsequently heating the cold rolled steel sheet to increase the temperature thereof with use of a direct flame burner (C) having an air ratio of not more than 0.89 when the temperature of the cold rolled steel sheet is in the temperature range of not less than Tb° C. and not more than Tc° C., and thereafter soak-annealing the cold rolled steel sheet in a furnace having an atmospheric gas composition which has a dew point of not more than −25° C. and contains 1 to 10 volume % of $H_2$ and the balance of $N_2$, with the proviso that 450° C.≤Ta° C.≤550° C., 650° C.≤Tb° C.≤800° C., 700° C.≤Tc° C.≤850° C. and Tb° C.<Tc° C.

(3) A third method for manufacturing high-Si cold rolled steel sheets having excellent chemical conversion properties according to the first method or the second method, wherein the cold rolled steel sheet further contains at least one of Cr at 0.01 to 1 mass %, Mo at 0.01 to 1 mass %, Ni at 0.01 to 1 mass % and Cu at 0.01 to 1 mass %.

(4) A fourth method for manufacturing high-Si cold rolled steel sheets having excellent chemical conversion properties according to any method of the first method to the third method, wherein the cold rolled steel sheet further contains at least one of Ti at 0.001 to 0.1 mass %, Nb at 0.001 to 0.1 mass % and V at 0.001 to 0.1 mass %.

(5) A fifth method for manufacturing high-Si cold rolled steel sheets having excellent chemical conversion properties according to any method of the first method to the fourth method, wherein the cold rolled steel sheet further contains B at 0.0003 to 0.005 mass %.

(6) A sixth method for manufacturing high-Si cold rolled steel sheets having excellent chemical conversion properties according to any method of the second method to the fifth method, wherein the time for which the cold rolled steel sheet is heated with the direct flame burner (B) having an air ratio of not less than 0.95 is not less than the time for which the cold rolled steel sheet is heated with the direct flame burner (C) having an air ratio of not more than 0.89.

According to an embodiment of the present invention, Si present inside the cold rolled steel sheet is oxidized utilizing the oxidation of Fe on the surface of the cold rolled steel sheet using the direct flame burners as well as utilizing subsequent reduction. As a result, it becomes possible to produce high-Si cold rolled steel sheets containing Si at 0.6% or more that are improved in chemical conversion properties while exhibiting a tensile strength of not less than 590 MPa and excellent workability with TS×EL being not less than 18000 MPa·%. Further, the inventive methods are free from the need of controlling the composition of an atmospheric gas during annealing, in particular the need of controlling the dew point of such a gas at a high temperature. Thus, the inventive methods are advantageous in terms of operation controllability, and can remedy problems such as accelerated degradation of furnace walls and rolls in the furnace as well as the generation of scale defects called pickups on the surface of steel sheet.

DESCRIPTION OF EMBODIMENTS OF THE INVENTION

There will be described the reasons why the chemical composition of the steel sheets of interest is limited. The indication of [%] regarding the composition means mass % unless otherwise mentioned.

Si is an element that increases strength without lowering the workability of steel sheets. At less than 0.6%, workability, namely, TS×EL is deteriorated. The Si content is preferably in excess of 1.10%. However, adding Si in excess of 3.0% results in a marked embrittlement of steel sheets as well as deteriorations in workability and chemical conversion properties. Thus, the upper limit of Si content is defined to be 3.0%.

In addition to Si, the chemical composition of the steel sheet contains C and Mn, which have a solid solution strengthening ability and a martensite forming ability, at contents of not less than 0.05%, preferably not less than 0.10% for C and not less than 1.0% for Mn in order to control the microstructure to such a phase as ferrite-martensite or ferrite-bainite-retained austenite and thereby to obtain desired mechanical properties. If C and Mn are added in an excessively large amount, the workability of steel sheets is markedly decreased. Thus, the C and Mn contents are defined to be not more than 0.3% and not more than 3.0%, respectively.

Al is added as a deoxidizer. At less than 0.01%, the effect thereof becomes insufficient. On the other hand, adding Al in an amount exceeding 1% is not economical because the effect is saturated. Thus, the Al content is defined to be 0.01 to 1%.

In addition, P, S and N are present. The P content is not more than 0.1%, and preferably not more than 0.015%. The S content is not more than 0.05%, and preferably not more than 0.003%. The N content is not more than 0.01%.

In order to control the mechanical properties and the microstructure, the steel sheet may contain at least one of Cr at 0.01 to 1%, Mo at 0.01 to 1%, Ni at 0.01 to 1% and Cu at 0.01 to 1%. In order to increase the strength of the steel sheet, the steel sheet may contain at least one of Ti at 0.001 to 0.1%, Nb at 0.001 to 0.1% and V at 0.001 to 0.1%. In order to increase the strength as well as the strength after paint baking, the steel sheet may contain B at 0.0003 to 0.005%. If these contents are below the respective lower limits, desired effects are not obtained. If these elements are added in excess of the respective upper limits, the effects are saturated. Thus, the respective lower and upper limits are defined as described above.

The balance is represented by Fe and inevitable impurities.

Next, the manufacturing methods will be described.

Steel having the above chemical composition is hot rolled, subsequently pickled, then cold rolled, and thereafter continuously annealed in a continuous annealing line. The method for manufacturing cold rolled steel sheets until before the continuous annealing is not particularly limited and may be performed using known procedures.

In the continuous annealing line, three consecutive steps, namely, heating, soaking and cooling are carried out. A general continuous annealing line is provided with a heating furnace for heating the steel sheet, a soaking furnace for soaking the steel sheet, and a cooling furnace for cooling the steel sheet, or is further provided with a preheating furnace before the heating furnace.

In the heating furnace, the steel sheet is heated using direct flame burners. By increasing the temperature of the steel sheet while regulating the air ratio of the direct flame burner used in the heating furnace to be not less than 0.95, an iron oxide (an Fe oxide) is formed on the surface of steel sheet. The iron oxide is reduced in the subsequent soaking furnace, and oxygen is diffused into the inside of steel sheet. As a result, Si is oxidized inside the steel sheet without reaching the surface of steel sheet, thus achieving good chemical conversion properties. In the present invention, the formation of iron oxide during heating is advantageous. If a sufficient amount of iron oxide is not formed, Si will be oxidized on the surface of steel sheet to form $SiO_2$, which deteriorates chemical conversion properties.

The steel sheet is heated with use of a direct flame burner having an air ratio of not more than 0.89 when the temperature of the steel sheet is in the temperature range of not less than 300° C. and less than Ta° C. (wherein 450° C.≤Ta° C.≤550° C.), and subsequently with use of a direct flame burner having an air ratio of not less than 0.95 when the temperature of the steel sheet is in the temperature range of not less than Ta° C. and less than Tb° C. (wherein 650° C.≤Tb° C.≤800° C.). In this manner, the amount of iron oxide is increased. It may be intuitively considered that the amount of iron oxide would be larger when a direct flame burner having an air ratio of not less than 0.95, which gives an oxidizing atmosphere, is used for the entire range of temperatures. However, the fact is that a larger amount of iron oxide resulted when the steel sheet was heated with a direct flame burner having an air ratio of not more than 0.89 for the range of temperatures from not less than 300° C. to less than Ta° C. Here, the air ratio is a ratio of the amount of introduced air relative to the amount of air required for complete combustion.

The reasons for this fact are not clear but can be assumed to be as follows.

Principal elements that can contribute to the oxidation of steel sheets include Fe, Si and O. Possible oxides of these elements are $SiO_2$ and Fe—Si composite oxides such as $Fe_2SiO_4$. Because $SiO_2$ works as a barrier to the permeation of oxygen, the rate of increase of iron oxide is markedly lowered after $SiO_2$ has been formed. On the other hand, Fe—Si composite oxides such as $Fe_2SiO_4$ do not work as oxygen permeation barriers and thus do not suppress the increase of iron oxide after such composite oxides have been formed. Thus, it can be said that forming an Fe—Si composite oxide is preferable when a large amount of iron oxide is desired. In terms of a theory of equilibrium, the conditions for the formation of $SiO_2$ and an Fe—Si composite oxide are such that the formation of $SiO_2$ is favored at a lower temperature and the formation of an Fe—Si composite oxide comes to be more favored as the temperature becomes higher. Further, the formation of $SiO_2$ is favored when the oxygen potential is higher, and the formation of an Fe—Si composite oxide is favored when the oxygen potential is lower. At low temperatures from 300° C. to less than Ta° C., at which the formation of $SiO_2$ is favored, the formation of $SiO_2$ is prevented by lowering the oxygen potential (controlling the air ratio to be not more than 0.89). This probably explains why the amount of iron oxide is increased.

If the temperature Ta° C. of steel sheet is below 450° C. or above 550° C. at the completion of heating with a direct flame burner having an air ratio of not more than 0.89, the effect of suppressing the formation of $SiO_2$ becomes insufficient. Thus, it is necessary that the temperature Ta° C. of steel sheet at the completion of such heating be not less than 450° C. and not more than 550° C.

From the viewpoint of the formation of Fe oxide, it is necessary that the temperature Tb° C. of steel sheet be not less than 650° C. at the completion of heating with a direct flame burner having an air ratio of not less than 0.95. The temperature Tb° C. of steel sheet at the completion of such heating is favorably as high as possible, and is preferably elevated to not less than 700° C., and more preferably not less than 750° C. However, excessive oxidation results in the exfoliation of Fe oxide in the subsequent reducing atmosphere furnace, which causes the occurrence of pickups. Thus, it is necessary that the temperature Tb° C. of steel sheet at the completion of such heating be not more than 800° C.

For the aforementioned reasons, the steel sheet is heated with use of a direct flame burner (A) having an air ratio of not more than 0.89 when the temperature of the steel sheet that is being increased is in the temperature range of not less than 300° C. and less than Ta° C., and subsequently with use of a direct flame burner (B) having an air ratio of not less than 0.95 when the temperature of the steel sheet is in the temperature range of not less than Ta° C. and less than Tb° C. Here, 450° C.≤Ta° C.≤550° C. and 650° C.≤Tb° C.≤800° C.

The procedures for heating the steel sheet while the temperature is in the range of less than 300° C. are not particularly limited. The steel sheet may be heated to To° C. (wherein To° C.<300° C.) in the preheating furnace and continuously heated with the direct flame burner. Alternatively, the steel sheet may be heated with the direct flame burner from the start.

In order to prevent excessive oxidation of Fe in the heating furnace, it is possible to heat the steel sheet in the aforementioned manner with use of the direct flame burner (A) having an air ratio of not more than 0.89 and subsequently in the aforementioned manner with use of the direct flame burner (B) having an air ratio of not less than 0.95, and thereafter to heat the steel sheet with use of a direct flame burner (C) having an air ratio of not more than 0.89.

In this case, the steel sheet is heated with use of the direct flame burner (C) having an air ratio of not more than 0.89 when the temperature of the steel sheet is not less than Tb° C. The direct flame burner (C) having an air ratio of not more than 0.89 allows for heating under an Fe atmospheric gas composition. In order to suppress excessive oxidation of Fe at the exit of the heating furnace and to prevent the occurrence of scale defects called pickups by the contact of steel sheet with rolls during the transportation from the heating furnace exit to the inside of the soaking furnace, it is necessary that heating with the direct flame burner (C) having an air ratio of not more than 0.89 bring the temperature Tc° C. of steel sheet to not less than 700° C. at the completion of heating. However, it is empirically known that heating the steel sheet to an excessively high temperature causes such a large temperature difference between the inlet side and the outlet side in the heating furnace that the steel sheet swings to the right and to the left in a serpentine movement so as to end up to be broken in the furnace. Thus, it is necessary that the temperature Tc° C. of steel sheet be not more than 850° C. at the completion of heating. In the case where the steel sheet is heated and the temperature thereof is increased with use of the direct flame burner (C) having an air ratio of not more than 0.89, the steel sheet is heated and the temperature thereof is increased with use of the direct flame burner (C) having an air ratio of not more than 0.89 when the temperature of steel sheet is in the temperature range of not less than Tb° C. and not more than Tc° C. Here, 700° C.≤Tc° C.≤850° C. and Tb° C.<Tc° C.

In order to obtain the aforementioned effects, the time for which the steel sheet is heated with the direct flame burner (B) having an air ratio of not less than 0.95 is preferably not less than the time for which the steel sheet is heated with the direct flame burner (C) having an air ratio of not more than 0.89.

Here, the direct flame burner is a type of burner which heats a steel sheet by applying directly to the surface of the steel sheet a burner flame that is produced by burning a mixture of air and a fuel such as coke oven gas (COG) which is a by-produced gas in a steelmaking plant. Because such a direct flame burner increases the temperature of steel sheet at a higher rate than radiation heating, it provides advantages such as reducing the length of the heating furnace and increasing the line speed. When the air ratio of the direct flame burner is set at 0.95 or more to increase the proportion of air relative to the fuel, excess oxygen remains in the flame and allows for the acceleration of the oxidation of steel sheet. The higher the air ratio, the higher the oxidizing power. Thus, from the viewpoint of the formation of Fe oxide, it is preferable that the air ratio be as high as possible, and that the air ratio be 1.10 or more. However, an excessively high air ratio causes the steel sheet to be excessively oxidized with the result that the Fe oxide is exfoliated in the subsequent soaking furnace having a reducing atmosphere, thus causing pickups. Accordingly, the air ratio is preferably not more than 1.30.

The air ratio of the direct flame burner (A) having an air ratio of not more than 0.89, and the air ratio of the direct flame burner (C) having an air ratio of not more than 0.89 are preferably not less than 0.7 from the viewpoint of combustion efficiency.

Examples of the fuels used in the direct flame burners include COG and liquefied natural gas (LNG).

After the steel sheet is heated and the temperature thereof is increased with the direct flame burners as described above, the steel sheet is soak-annealed in a soaking furnace provided with a radiant tube burner. The composition of a atmospheric gas that is introduced into the soaking furnace contains 1 to 10 volume % of $H_2$ and the balance of $N_2$. The reasons why the $H_2$ % introduced into the soaking furnace is limited to 1 to 10 volume % are as follows.

If the proportion is less than 1 volume %, the amount of $H_2$ is insufficient to reduce the Fe oxide on the surface of steel sheet that is continuously passed through the furnace. Even if the proportion exceeds 10 volume %, the reduction of Fe oxide is saturated and the excess $H_2$ is wasted. If the dew point is above −25° C., oxidation with oxygen of $H_2O$ in the furnace becomes marked resulting in excessive internal oxidation of Si. Accordingly, the dew point is limited to not more than −25° C. Such a atmospheric gas having a dew point of not more than −25° C. and containing 1 to 10 volume % of $H_2$ and the balance of $N_2$ gas permits the inside of the soaking furnace to have an Fe reducing gas composition. Thus, the Fe oxide that has been formed in the heating furnace is reduced. At this time, part of the oxygen atoms separated from Fe by the reduction diffuse into the steel sheet and react with Si to form the internal oxide $SiO_2$. Because Si is oxidized inside the steel sheet and the amount of Si oxide on the outermost surface of steel sheet on which a chemical conversion reaction takes place is reduced, good chemical conversion properties are obtained.

From the viewpoint of conditioning the mechanical properties, the soak-annealing is performed at a steel sheet temperature in the range of 750° C. to 900° C. The soaking time is preferably 20 seconds to 180 seconds. Steps that follow the soak-annealing are variable in accordance with the type of product, and such steps are not particularly limited in the invention. For example, the soak-annealing is followed by cooling with a gas, mist, water or the like and further followed by tempering at 150° C. to 400° C. as required. After the cooling or the tempering, pickling may be performed using an acid such as hydrochloric acid or sulfuric acid in order to condition surface properties. The acid concentration used for pickling is preferably 1 to 20 mass %, the acid temperature is preferably 30 to 90° C., and the pickling time is preferably 5 to 30 seconds. The steel sheet may be anodically dissolved by the passage of electric current through the steel sheet during pickling. In performing anodic dissolution, the current density is such that the current needed for the passivation of iron is not reached. The passivation current density depends on the temperature and the concentration of the acid.

EXAMPLE 1

Steels A to L that had the chemical compositions shown in Table 1 were each hot rolled, pickled and cold rolled by known procedures to give steel sheets having a thickness of 1.5 mm. The steel sheets were each annealed by being passed through a continuous annealing line which had a preheating furnace, a heating furnace provided with direct flame burners, a radiant tube type soaking furnace and a cooling furnace, thereby manufacturing high strength cold rolled steel sheets. COG was used as the fuel in the direct flame burners, and the air ratios were changed to various values. Cooling after the soaking was performed with water, mist or gas as described in Table 2. Further, the steel sheets were pickled with the acid described in Table 2 or were directly obtained as products. Heating with the direct flame burner (A) was performed from when the temperature of the steel sheet was 150° C.

The pickling conditions were as follows.

Pickling with hydrochloric acid: acid concentration 10 mass %, acid temperature 55° C., pickling time 10 sec Pickling with sulfuric acid: acid concentration 10 mass %, acid temperature 55° C., pickling time 10 sec The obtained high strength cold rolled steel sheets were tested to evaluate mechanical properties and chemical conversion properties.

To evaluate mechanical properties, a JIS No. 5 test piece (JIS Z2201) was sampled along a direction that was perpendicular to the rolling direction, and was tested in accordance with JIS Z2241. Workability was evaluated based on the value obtained by tensile strength (TS)×elongation (EL). The mechanical properties were evaluated to be ○ when TS×EL was 18000 or more and TS was 590 MPa or more, and were evaluated to be x when one or both of these values were less than the above-described values.

Next, procedures for evaluating chemical conversion properties are described below.

A chemical conversion liquid (PALBOND L3080 (registered trademark)) manufactured by Nihon Parkerizing Co., Ltd. was used. A chemical conversion treatment was carried out in the following manner.

The steel sheet was degreased with degreasing liquid FINE CLEANER (registered trademark) manufactured by Nihon Parkerizing Co., Ltd., and was thereafter washed with water. Subsequently, the surface of the steel sheet was conditioned for 30 seconds with surface conditioning liquid PREPAREN Z (registered trademark) manufactured by Nihon Parkerizing Co., Ltd. The steel sheet was then soaked in the chemical conversion liquid (PALBOND L3080) at 43° C. for 120 seconds, washed with water and dried with hot air.

The chemical conversion layer was observed with a scanning electron microscope (SEM) at 500× magnification with respect to five fields of view that had been randomly selected. The ratio of the areas non-covered with the chemical conversion layer was measured by image processing. The following evaluation was made on the basis of the ratio of the non-covered areas. The symbols ○ and ⊙ indicate acceptable levels.

⊙: not more than 5%

○: more than 5% and not more than 10%

Δ: more than 10% and not more than 25% x: more than 25%

Table 2 shows the steels used in this EXAMPLE, the manufacturing conditions in the continuous annealing line and the evaluation results.

TABLE 1

Unit: mass %

| Steel code | C | Si | Mn | P | S | Al | N | Ti | Nb | V | Cr | Mo | Cu | Ni | B | Remarks |
|---|---|---|---|---|---|---|---|---|---|---|---|---|---|---|---|---|
| A | 0.12 | 1.43 | 1.9 | 0.02 | 0.003 | 0.01 | 0.004 | | | | | | | | | Inventive steel |
| B | 0.08 | 1.62 | 2.5 | 0.01 | 0.002 | 0.03 | 0.003 | 0.03 | | | | | | | 0.0013 | Inventive steel |
| C | 0.15 | 0.85 | 1.6 | 0.02 | 0.005 | 0.02 | 0.005 | | 0.05 | | 0.35 | | | | | Inventive steel |
| D | 0.20 | 1.51 | 2.5 | 0.02 | 0.002 | 0.01 | 0.007 | 0.05 | | | 0.01 | 0.01 | | | 0.0033 | Inventive steel |
| E | 0.10 | 1.15 | 2.1 | 0.03 | 0.040 | 0.03 | 0.004 | | 0.005 | 0.01 | | | | | 0.0003 | Inventive steel |
| F | 0.25 | 1.30 | 2.9 | 0.02 | 0.003 | 0.04 | 0.003 | | | | | | | | | Inventive steel |
| G | 0.09 | 2.89 | 1.8 | 0.01 | 0.002 | 0.45 | 0.002 | | | | | | 0.4 | 0.2 | | Inventive steel |
| H | 0.04 | 1.20 | 1.2 | 0.01 | 0.002 | 0.03 | 0.005 | | | | | | | | | Comparative Steel |
| I | 0.15 | 0.40 | 1.6 | 0.02 | 0.001 | 0.03 | 0.003 | | 0.02 | | | | | | | Comparative Steel |

TABLE 1-continued

Unit: mass %

| Steel code | C | Si | Mn | P | S | Al | N | Ti | Nb | V | Cr | Mo | Cu | Ni | B | Remarks |
|---|---|---|---|---|---|---|---|---|---|---|---|---|---|---|---|---|
| J | 0.08 | 3.15 | 1.6 | 0.03 | 0.004 | 0.04 | 0.003 | | | | | | | | | Comparative Steel |
| K | 0.06 | 1.80 | 0.9 | 0.02 | 0.004 | 0.03 | 0.003 | | | | | | | | 0.0005 | Comparative Steel |
| L | 0.13 | 2.60 | 3.1 | 0.01 | 0.003 | 0.05 | 0.005 | | | | | | | | | Comparative Steel |

TABLE 2

| | | Heating conditions in heating furnace | | | | | | Soaking furnace atmosphere, and soaking and cooling conditions | | | | |
|---|---|---|---|---|---|---|---|---|---|---|---|---|
| | | Direct flame burner (A) | | | Direct flame burner (B) | | | | | | | |
| No. | Steel code | Air ratio | ○: air ratio less than 0.89, X: air ratio not less than 0.89 | Ta: Heating finish temperature of direct flame burner (A) (° C.) | Air ratio | ○: air ratio not less than 0.95, X: air ratio less than 0.95 | Tb: Heating finish temperature of direct flame burner (B) (° C.) | Hydrogen concentration (volume %) | Dew point (° C.) | Soaking temperature (° C.) | Soaking time (sec) | Cooling conditions |
| 1 | A | 0.80 | ○ | 500 | 1.00 | ○ | 740 | 6% | −42 | 830 | 30 | Water |
| 2 | A | 0.83 | ○ | 540 | 0.95 | ○ | 800 | 6% | −42 | 830 | 30 | Water |
| 3 | A | 0.88 | ○ | 400 | 1.15 | ○ | 670 | 6% | −42 | 830 | 30 | Mist |
| 4 | A | 0.98 | X | 500 | 0.98 | ○ | 700 | 6% | −42 | 830 | 30 | Water |
| 5 | A | 0.80 | ○ | 510 | 0.85 | X | 720 | 6% | −42 | 830 | 30 | Water |
| 6 | A | 0.80 | ○ | 570 | 1.03 | ○ | 730 | 6% | −42 | 830 | 30 | Water |
| 7 | A | 0.88 | ○ | 390 | 1.15 | ○ | 630 | 6% | −42 | 830 | 30 | Water |
| 8 | B | 0.83 | ○ | 420 | 1.10 | ○ | 800 | 7% | −38 | 830 | 20 | Water |
| 9 | C | 0.87 | ○ | 540 | 1.12 | ○ | 780 | 5% | −30 | 800 | 60 | Mist |
| 10 | D | 0.82 | ○ | 450 | 1.10 | ○ | 770 | 10% | −45 | 800 | 100 | Gas |
| 11 | E | 0.84 | ○ | 490 | 1.11 | ○ | 760 | 7% | −35 | 840 | 120 | Mist |
| 12 | F | 0.83 | ○ | 480 | 0.98 | ○ | 700 | 6% | −42 | 780 | 60 | Gas |
| 13 | G | 0.82 | ○ | 530 | 1.00 | ○ | 780 | 7% | −38 | 890 | 100 | Water |
| 14 | H | 0.80 | ○ | 460 | 1.05 | ○ | 800 | 6% | −42 | 830 | 20 | Water |
| 15 | I | 0.83 | ○ | 480 | 1.00 | ○ | 760 | 7% | −38 | 830 | 90 | Gas |
| 16 | J | 0.82 | ○ | 490 | 1.20 | ○ | 700 | 5% | −30 | 820 | 140 | Water |
| 17 | K | 0.81 | ○ | 470 | 1.00 | ○ | 770 | 5% | −30 | 750 | 50 | Water |
| 18 | L | 0.83 | ○ | 480 | 1.10 | ○ | 760 | 3% | −25 | 800 | 120 | Gas |

| | | Mechanical properties | | | | | Ratio of area non-covered with chemical conversion layer | |
|---|---|---|---|---|---|---|---|---|
| No. | Pickling | YS (MPa) | TS (MPa) | EL (%) | TS × EL (Mpa · %) | Evaluation | | |
| 1 | Hydrochloric acid | 810 | 1030 | 18.2 | 18782 | ○ | ◎ | INV. EX. 1 |
| 2 | Sulfuric acid | 800 | 1010 | 18.9 | 19120 | ○ | ◎ | INV. EX. 2 |
| 3 | Hydrochloric acid | 810 | 1010 | 18.5 | 18635 | ○ | ○ | INV. EX. 3 |
| 4 | Sulfuric acid | 820 | 1030 | 18.7 | 19230 | ○ | Δ | COMP. EX. 1 |
| 5 | Sulfuric acid | 810 | 1030 | 18.1 | 18643 | ○ | X | COMP. EX. 2 |
| 6 | Sulfuric acid | 820 | 1020 | 18.9 | 19278 | ○ | Δ | COMP. EX. 3 |
| 7 | Sulfuric acid | 810 | 1020 | 18.3 | 18666 | ○ | X | COMP. EX. 4 |
| 8 | — | 680 | 830 | 22.1 | 18343 | ○ | ◎ | INV. EX. 4 |
| 9 | Hydrochloric acid | 800 | 1020 | 18.5 | 18870 | ○ | ◎ | INV. EX. 5 |
| 10 | — | 1010 | 1280 | 14.8 | 18944 | ○ | ◎ | INV. EX. 6 |
| 11 | Hydrochloric acid | 760 | 955 | 19.0 | 18145 | ○ | ◎ | INV. EX. 7 |
| 12 | Sulfuric acid | 1150 | 1470 | 12.8 | 18816 | ○ | ◎ | INV. EX. 8 |
| 13 | Hydrochloric acid | 670 | 830 | 25.5 | 21165 | ○ | ○ | INV. EX. 9 |
| 14 | Sulfuric acid | 410 | 540 | 35.2 | 19008 | X | ◎ | COMP. EX. 5 |
| 15 | Hydrochloric acid | 810 | 1030 | 14.1 | 14523 | X | ○ | COMP. EX. 6 |
| 16 | Sulfuric acid | 680 | 870 | 12.1 | 10527 | X | X | COMP. EX. 7 |
| 17 | Sulfuric acid | 410 | 480 | 39.5 | 18960 | X | ◎ | COMP. EX. 8 |
| 18 | Sulfuric acid | 1110 | 1320 | 8.8 | 11616 | X | ○ | COMP. EX. 9 |

The results in Table 2 revealed the following. INVENTIVE EXAMPLES 1 to 9 in which the chemical composition of steel and the manufacturing conditions were within the inventive ranges resulted in TS of not less than 590 MPa and TS×EL exceeding 18000, as well as good chemical conversion properties. On the other hand, COMPARATIVE EXAMPLES 5 to 9, in which the chemical composition of steel was outside the inventive ranges, resulted in TS of less than 590 MPa or TS×EL of less than 18000, indicating that the steel sheets were poor in either strength or workability. COMPARATIVE EXAMPLES 1 to 4, in which the heating conditions in the heating furnace were outside the inventive ranges, resulted in poor chemical conversion properties.

EXAMPLE 2

Steel A that had the chemical composition shown in Table 1 was hot rolled, pickled and cold rolled by known procedures to give a steel sheet having a thickness of 1.5 mm. The steel sheet was annealed by being passed through a continuous annealing line which had a preheating furnace, a heating furnace provided with direct flame burners, a radiant tube type soaking furnace and a cooling furnace, thereby manufacturing a high strength cold rolled steel sheet. COG was used as the fuel in the direct flame burners, and the air ratios were changed to various values. Cooling after the soaking was performed with water as described in Table 3. Further, the steel sheet was pickled with sulfuric acid as described in Table 3 to give a product. Heating with the direct flame burner (A) was performed from when the temperature of the steel sheet was 150° C.

The obtained high strength cold rolled steel sheets were tested to evaluate mechanical properties and chemical conversion properties. The mechanical properties and the chemical conversion properties were evaluated by the same procedures as those described in EXAMPLE 1.

Table 3 shows the steel used in this EXAMPLE, the manufacturing conditions in the continuous annealing line and the evaluation results.

TABLE 3

| | | Heating conditions in heating furnace | | | | | | | | | | |
|---|---|---|---|---|---|---|---|---|---|---|---|---|
| | | Direct flame burner (A) | | | Direct flame burner (B) | | | Direct flame burner (C) | | | | |
| No. | Steel code | Air ratio | ○: air ratio less than 0.89, X: air ratio not less than 0.89 | Ta: Heating finish temperature of direct flame burner (A) (° C.) | Air ratio | ○: air ratio not less than 0.95, X: air ratio less than 0.95 | Tb: Heating finish temperature of direct flame burner (B) (° C.) | Air ratio | ○: air ratio less than 0.89, X: air ratio not less than 0.89 | Tc: Heating finish temperature of direct flame burner (C) (° C.) | Ratio of heating time with direct flame burner (B) to heating time with direct flame burner (C) | |
| | | | | | | | | | | | Time ratio* | ○: not less than 1, X: less than 1 |
| 1 | A | 0.85 | ○ | 500 | 1.00 | ○ | 660 | 0.83 | ○ | 740 | 1.8 | ○ |
| 2 | A | 0.85 | ○ | 540 | 0.95 | ○ | 721 | 0.83 | ○ | 800 | 2.7 | ○ |
| 3 | A | 0.85 | ○ | 520 | 1.15 | ○ | 660 | 0.83 | ○ | 760 | 1.2 | ○ |
| 4 | A | 0.85 | ○ | 500 | 0.98 | ○ | 680 | 0.83 | ○ | 750 | 2.5 | ○ |
| 5 | A | 0.85 | ○ | 510 | 0.98 | ○ | 670 | 0.83 | ○ | 750 | 0.9 | X |
| 6 | A | 0.85 | ○ | 520 | 1.03 | ○ | 590 | 0.83 | ○ | 640 | 1.2 | ○ |
| 7 | A | 1.02 | X | 510 | 0.98 | ○ | 620 | 0.83 | ○ | 700 | 1.2 | ○ |
| 8 | A | 0.80 | ○ | 500 | 0.86 | X | 620 | 0.83 | ○ | 710 | 1.2 | ○ |

| | Soaking furnace atmosphere, and soaking and cooling conditions | | | | | | Mechanical properties | | | | | Ratio of area non-covered with chemical conversion layer | |
|---|---|---|---|---|---|---|---|---|---|---|---|---|---|
| No. | Hydrogen concentration (volume %) | Dew point (° C.) | Soaking temperature (° C.) | Soaking time (° C.) | Cooling conditions | Pickling | YS (MPa) | TS (MPa) | EL (%) | TS × EL (Mpa · %) | Evaluation | | |
| 1 | 6% | −42 | 830 | 30 | Water | Sulfuric acid | 800 | 1010 | 18.6 | 18786 | ○ | ◎ | INV. EX. 1 |
| 2 | 6% | −42 | 830 | 30 | Water | Sulfuric acid | 810 | 1030 | 18.7 | 19261 | ○ | ◎ | INV. EX. 2 |
| 3 | 6% | −42 | 830 | 30 | Water | Sulfuric acid | 820 | 1010 | 18.8 | 18988 | ○ | ◎ | INV. EX. 3 |
| 4 | 6% | −42 | 830 | 30 | Water | Sulfuric acid | 820 | 1030 | 18.3 | 18849 | ○ | ◎ | INV. EX. 4 |
| 5 | 6% | −42 | 830 | 30 | Water | Sulfuric acid | 830 | 1020 | 18.6 | 18972 | ○ | ○ | INV. EX. 5 |
| 6 | 6% | −42 | 830 | 30 | Water | Sulfuric acid | 820 | 1020 | 18.6 | 18972 | ○ | X | COMP. EX. 1 |
| 7 | 6% | −42 | 830 | 30 | Water | Sulfuric acid | 820 | 1020 | 18.4 | 18768 | ○ | Δ | COMP. EX. 2 |
| 8 | 6% | −42 | 830 | 30 | Water | Sulfuric acid | 810 | 1010 | 18.2 | 18382 | ○ | X | COMP. EX. 3 |

*Time ratio = heating time with direct flame burner (B)/heating time with direct flame burner (C)

The results in Table 3 revealed the following. INVENTIVE EXAMPLES 1 to 5 in which the chemical composition of steel and the manufacturing conditions were within the inventive ranges resulted in TS of not less than 590 MPa and TS×EL exceeding 18000, as well as good chemical conversion properties. Among INVENTIVE EXAMPLES 1 to 5, chemical conversion properties were more superior when the heating time with the direct flame burner (B) was longer than the heating time with the direct flame burner (C) (INVENTIVE EXAMPLES 1 to 4) than when the heating time with the direct flame burner (B) was less than the heating time with the direct flame burner (C) (INVENTIVE EXAMPLE 5). COMPARATIVE EXAMPLES 1 to 3, in which the heating conditions in the heating furnace were outside the inventive ranges, resulted in poor chemical conversion properties.

The present invention may be utilized as methods for manufacturing high-Si cold rolled steel sheets which achieve good chemical conversion properties and exhibit a tensile strength of not less than 590 MPa and excellent workability with TS×EL being not less than 18000 MPa·%.

The invention claimed is:

1. A method for manufacturing high-Si cold rolled steel sheets having excellent chemical conversion properties which comprises:

heating a cold rolled steel sheet that has a chemical composition containing:

C at 0.05 to 0.3 mass %,

Si at 0.6 to 3.0 mass %,

Mn at 1.0 to 3.0 mass %,

P at not more than 0.1 mass %,

S at not more than 0.05 mass %,

Al at 0.01 to 1 mass %, and

N at not more than 0.01 mass %, with the balance being represented by Fe and inevitable impurities, with use of a direct flame burner (A) having an air ratio of not more than 0.89 when the temperature of the cold rolled steel sheet that is being increased is in the temperature range of not less than 300° C. and less than Ta° C.;

subsequently heating the cold rolled steel sheet with use of a direct flame burner (B) having an air ratio of not less than 0.95 when the temperature of the cold rolled steel sheet is in the temperature range of not less than Ta° C. and less than Tb° C.; and subsequently soak-annealing the cold rolled steel sheet in a furnace having an atmospheric gas composition which has a dew point of not more than −25° C. and contains 1 to 10 volume % of $H_2$ and the balance of $N_2$, with the proviso that 450° C.≤Ta° C.≤550° C. and 650° C.≤Tb° C.≤800° C.

2. A method for manufacturing high-Si cold rolled steel sheets having excellent chemical conversion properties which comprises:

heating a cold rolled steel sheet that has a chemical composition containing:

C at 0.05 to 0.3 mass %,

Si at 0.6 to 3.0 mass %,

Mn at 1.0 to 3.0 mass %,

P at not more than 0.1 mass %,

S at not more than 0.05 mass %,

Al at 0.01 to 1 mass %, and

N at not more than 0.01 mass %, with the balance being represented by Fe and inevitable impurities, with use of a direct flame burner (A) having an air ratio of not more than 0.89 when the temperature of the cold rolled steel sheet that is being increased is in the temperature range of not less than 300° C. and less than Ta° C.;

subsequently heating the cold rolled steel sheet with use of a direct flame burner (B) having an air ratio of not less than 0.95 when the temperature of the cold rolled steel sheet is in the temperature range of not less than Ta° C. and less than Tb° C.; and subsequently heating the cold rolled steel sheet to increase the temperature thereof with use of a direct flame burner (C) having an air ratio of not more than 0.89 when the temperature of the cold rolled steel sheet is in the temperature range of not less than Tb° C. and not more than Tc° C., and thereafter soak-annealing the cold rolled steel sheet in a furnace having an atmospheric gas composition which has a dew point of not more than −25° C. and contains 1 to 10 volume % of $H_2$ and the balance of $N_2$, with the proviso that 450° C.≤Ta° C.≤550° C., 650° C.≤Tb° C.≤800° C., 700° C.≤Tc° C.≤850° C. and Tb° C.<Tc° C.

3. The method for manufacturing high-Si cold rolled steel sheets having excellent chemical conversion properties according to claim 1 or 2, wherein the cold rolled steel sheet further contains at least one of Cr at 0.01 to 1 mass %, Mo at 0.01 to 1 mass %, Ni at 0.01 to 1 mass % and Cu at 0.01 to 1 mass %.

4. The method for manufacturing high-Si cold rolled steel sheets having excellent chemical conversion properties according to claim 1 or 2, wherein the cold rolled steel sheet further contains at least one of Ti at 0.001 to 0.1 mass %, Nb at 0.001 to 0.1 mass % and V at 0.001 to 0.1 mass %.

5. The method for manufacturing high-Si cold rolled steel sheets having excellent chemical conversion properties according to claim 1 or 2, wherein the cold rolled steel sheet further contains B at 0.0003 to 0.005 mass %.

6. The method for manufacturing high-Si cold rolled steel sheets having excellent chemical conversion properties according to claim 2, wherein the time for which the cold rolled steel sheet is heated with the direct flame burner (B) having an air ratio of not less than 0.95 is not less than the time for which the cold rolled steel sheet is heated with the direct flame burner (C) having an air ratio of not more than 0.89.

* * * * *